US006607369B1

(12) United States Patent
Yanase et al.

(10) Patent No.: US 6,607,369 B1
(45) Date of Patent: Aug. 19, 2003

(54) HERMETIC COMPRESSOR

(75) Inventors: Seigo Yanase, Kanagawa (JP); Hiroshi Sasano, Kanagawa (JP); Junichiro Yabiki, Kanagawa (JP); Takahide Nagao, Kanagawa (JP)

(73) Assignee: Matsushita Refrigeration Company, Osaka (JP)

( * ) Notice: Subject to any disclaimer, the term of this patent is extended or adjusted under 35 U.S.C. 154(b) by 0 days.

(21) Appl. No.: 10/009,632

(22) PCT Filed: Jun. 14, 2000

(86) PCT No.: PCT/JP00/03839

§ 371 (c)(1),
(2), (4) Date: Mar. 8, 2002

(87) PCT Pub. No.: WO00/77400

PCT Pub. Date: Dec. 21, 2000

(30) Foreign Application Priority Data

Jun. 14, 1999 (JP) ..... 11-166409

(51) Int. Cl.[7] ..... F04B 35/04

(52) U.S. Cl. ..... 417/415; 417/312; 417/313; 417/902; 181/403; 184/6.6

(58) Field of Search ..... 417/312, 313, 417/902, 415; 184/6.27, 11.1, 6.6; 181/403

(56) References Cited

U.S. PATENT DOCUMENTS 2,125,645 A 8/1938 Money
4,518,323 A * 5/1985 Elson et al. ..... 417/312
4,569,639 A 2/1986 Hannibal et al.
4,576,555 A * 3/1986 Ashenfelter ..... 417/372
5,201,640 A * 4/1993 Heinzelmann et al. ..... 417/312
5,322,419 A 6/1994 Novolan et al.
5,971,724 A * 10/1999 Choi ..... 417/415
5,980,222 A * 11/1999 Fry ..... 417/553
6,155,805 A * 12/2000 Fry ..... 417/415

FOREIGN PATENT DOCUMENTS

JP 8-284826 10/1996

* cited by examiner

*Primary Examiner*—Charles G. Freay
*Assistant Examiner*—Emmanuel Sayoc
(74) *Attorney, Agent, or Firm*—Wenderoth, Lind & Ponack, L.L.P.

(57) ABSTRACT

A closed motor-driven compressor includes a closed vessel containing a lubricating oil collected in a bottom portion thereof, a compression section accommodated in the closed vessel, and a motor section accommodated in the closed vessel for driving the compression section. The compression section includes a crankshaft driven by the motor section and having a lower end submerged in the lubricating oil, and a block for rotatably supporting the crankshaft. The block has a cylinder formed therewith and having an open end. The block also has a rib formed therewith, a generally flat shoulder portion formed on one side of the cylinder, and a leg formed below the generally flat shoulder portion. The compression section also includes a cylinder head secured to the rib for covering the open end of the cylinder. An oil guide is formed with the block for guiding to the bottom portion of the closed vessel a lubricating oil that is sucked up from the lower end of the crankshaft, caused to spout out from the upper end of the crankshaft, and collected on the generally flat shoulder portion. The oil guide prevent the oil from dropping on and flowing over a suction muffler disposed below the rib, and also prevents the oil from dropping directly on the bottom portion of the closed vessel.

2 Claims, 4 Drawing Sheets

*Fig. 4* - PRIOR ART
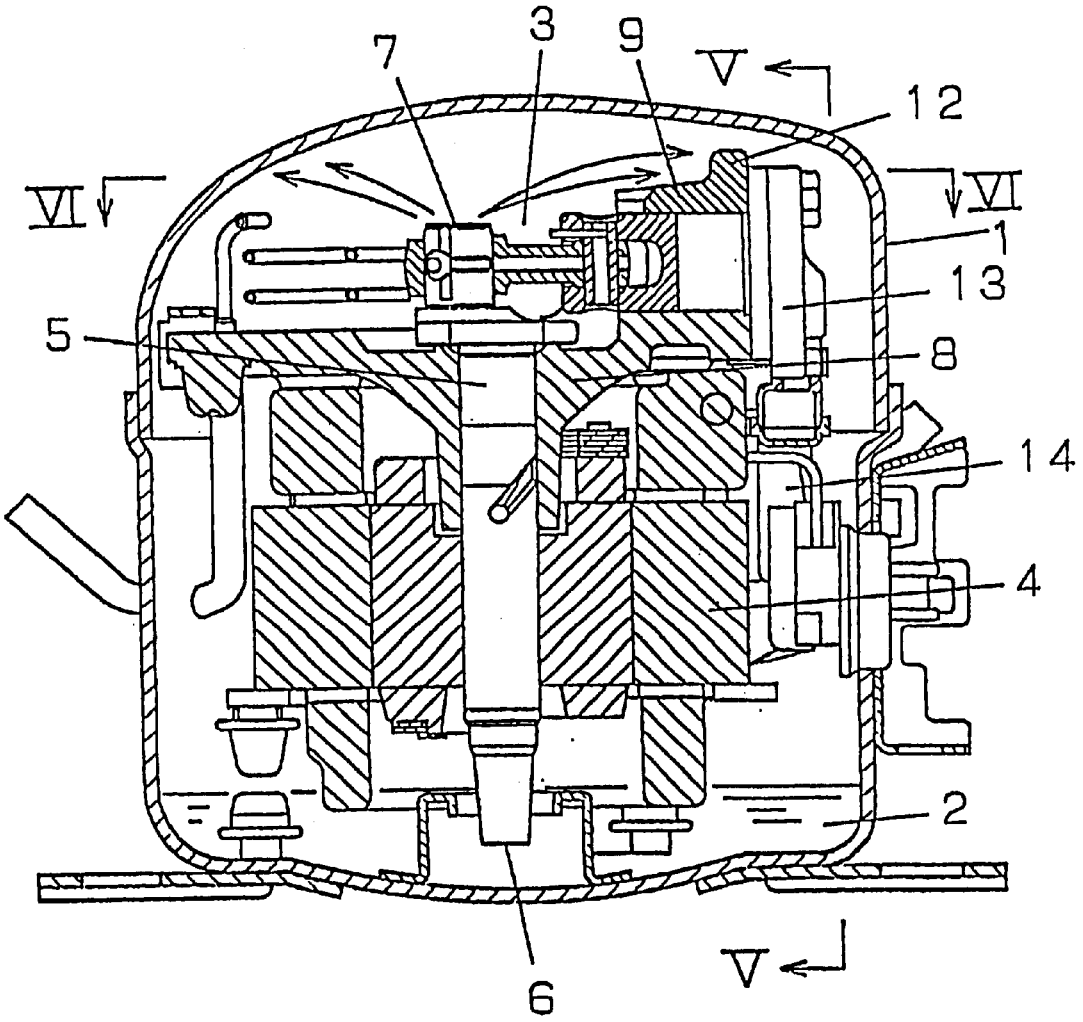

*Fig. 5* - PRIOR ART
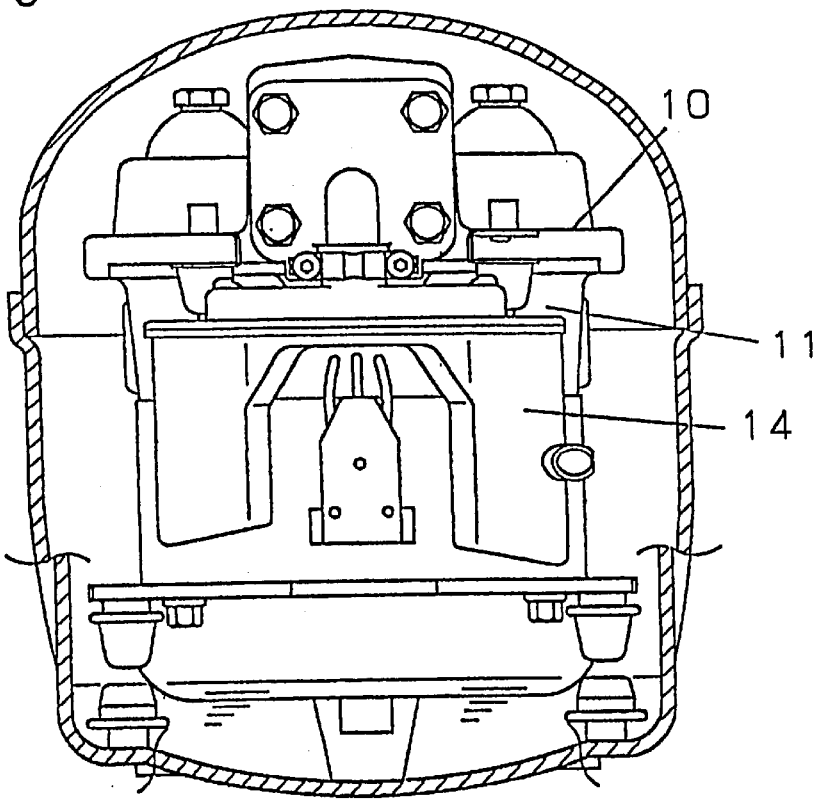
*Fig. 6* - PRIOR ART
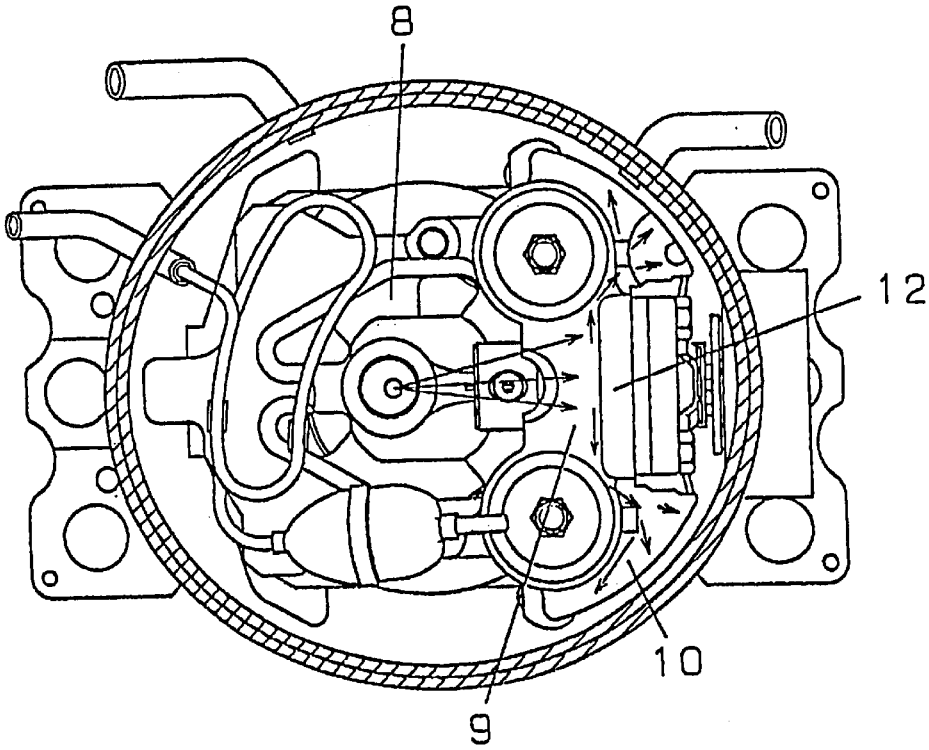

HERMETIC COMPRESSOR

TECHNICAL FIELD

The present invention relates to a closed motor-driven compressor that is connected to a refrigerating cycle provided in an electric refrigerator or the like.

BACKGROUND ART

FIG. 4 depicts a conventional closed motor-driven compressor as disclosed in Japanese Laid-Open Patent Publication (unexamined) No. 8-284826. The compressor shown therein includes a closed vessel 1 containing a lubricating oil 2 collected in a bottom portion thereof. The closed vessel 1 accommodates a compression section 3 and a motor section 4, both elastically supported therein. The compression section 3 is driven by the motor section 4 via a crankshaft 5, which has a lower end 6 submerged in the lubricating oil 2 and an upper end 7. The crankshaft 5 is rotatably supported by a block 8 having a cylinder 9 integrally formed therewith. The cylinder 9 has generally flat shoulder portions 10 formed on respective sides thereof. The block 8 is rigidly secured to the motor section 4 via two legs 11 and has a rib 12 integrally formed therewith. A cylinder head 13 for covering an open end of the cylinder 9 is secured to the rib 12, and a suction muffler 14 is disposed below the rib 12.

The conventional closed motor-driven compressor of the above-described construction operates as follows.

When the operation of the compressor is started, the crankshaft 5 is rotated by the motor section 4, and the lubricating oil 2 sucked up from the lower end 6 of the crankshaft 5 spouts out from the upper end 7 of the crankshaft 5 and is then sprinkled on the closed vessel 1, cylinder 9, rib 12 and the like. The resultant drops of oil flow towards the generally flat shoulder portions 10. When the oil collected on the generally flat shoulder portions 10 overflows, it flows down to the bottom portion of the closed vessel 1 over the peripheral edges of the generally flat shoulder portions 10.

In the above-described construction, however, the oil collected on the generally flat shoulder portions 10 drops on and flows over the suction muffler 14. Accordingly, the internal temperature of the suction muffler 14 increases and, hence, the temperature of a suction gas also increases, resulting in a reduction in compressor efficiency. In the case where the oil collected on the generally flat shoulder portions drops directly on the bottom portion of the closed vessel 1, noise is generated at the surface of oil collected therein.

U.S. Pat. No. 5,322,419 which forms the closest prior art from which the present invention starts discloses a freon operated compressor for domestic refrigerators having an electric motor which drives through a cramshaft a piston sliding inside a cylinder block. A system of valves is provided for suction and delivery of the working fluid. That known compressor comprises furthermore a hollow body with a suction port in coaxial relation with a pipe, opposite which a tripple pole terminal is arranged through which electrical power is applied. Finally, a pump is provided with an outward cylindrical member and an ogival member with inner longitudinal blades and outward radial blades.

The present invention has been developed to overcome the above-described disadvantages.

It is accordingly an objective of the present invention to provide an improved closed motor-driven compressor wherein the oil collected on the generally flat shoulder portions is guided to the bottom portion of the closed vessel, while preventing the oil from dropping on and flowing over the suction muffler, and also preventing the oil from dropping directly on the bottom portion of the closed vessel.

DISCLOSURE OF THE INVENTION

In accomplishing the above and other objectives, the closed motor-driven compressor according to the present invention includes a closed vessel containing a lubricating oil collected in a bottom portion thereof, a compression section accommodated in the closed vessel, and a motor section accommodated in the dosed vessel for driving the compression section. The compression section includes a crankshaft having a lower end submerged in the lubricating oil and an upper end, and a block for rotatably supporting the crankshaft. The block has a cylinder formed therewith and having an open end, and also has a rib formed therewith, a generally flat shoulder portion formed on one side of the cylinder, and a leg formed below the generally flat shoulder portion and secured to the motor section. A cylinder head is secured to the rib for covering the open end of the cylinder, and a suction muffler is disposed below the rib. An oil guide is formed with the block for guiding to the bottom portion of the closed vessel a lubricating oil that is sucked up from the lower end of the crankshaft, caused to spout out from the upper end of the crankshaft, and collected on the generally flat shoulder portion.

Said oil guide includes an oil retainer wall formed on one side of the rib and connected to both the rib and the generally flat shoulder portion.

Advantageously, the oil guide also includes an oil groove extending downwardly from the generally flat shoulder portion.

By this construction,the oil guide prevents the oil from dropping on and flowing over the suction muffler, and also prevents the oil from dropping directly on the bottom portion of the closed vessel.

BRIEF DESCRIPTION OF THE DRAWINGS

The above and other objectives and features of the present invention will become more apparent from the following description of a preferred embodiment thereof with reference to the accompanying drawings, throughout which like parts are designated by like reference numerals, and wherein:

FIG. 4 is a vertical sectional view of a conventional closed motor-driven compressor;

FIG. 5 is a sectional view taken along line V—V in FIG. 4; and

FIG. 6 is a sectional view taken along line VI—VI in FIG. 4.

DETAILED DESCRIPTION OF THE PREFERRED EMBODIMENTS

Figure 1:
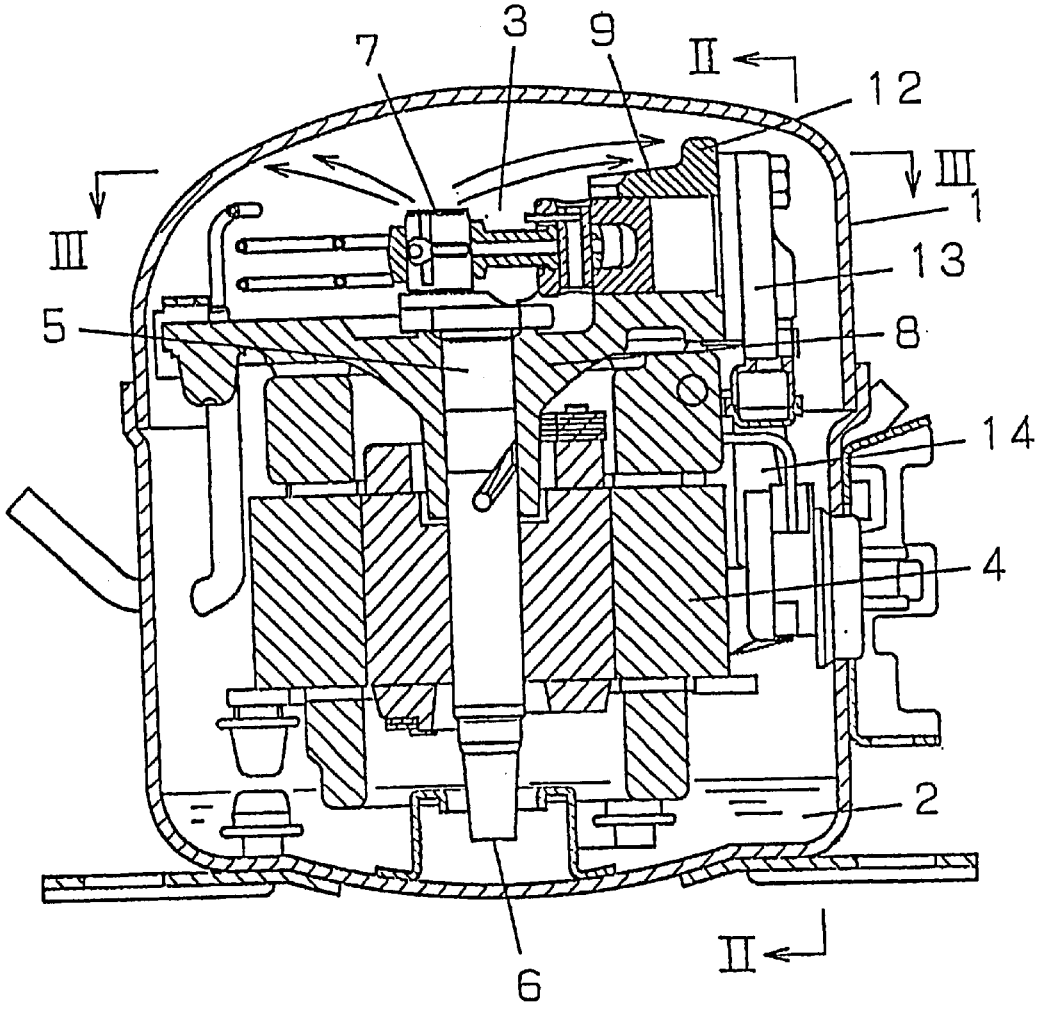
FIG. 1 is a vertical sectional view of a closed motor-driven compressor according to the present invention.
Figure 2:
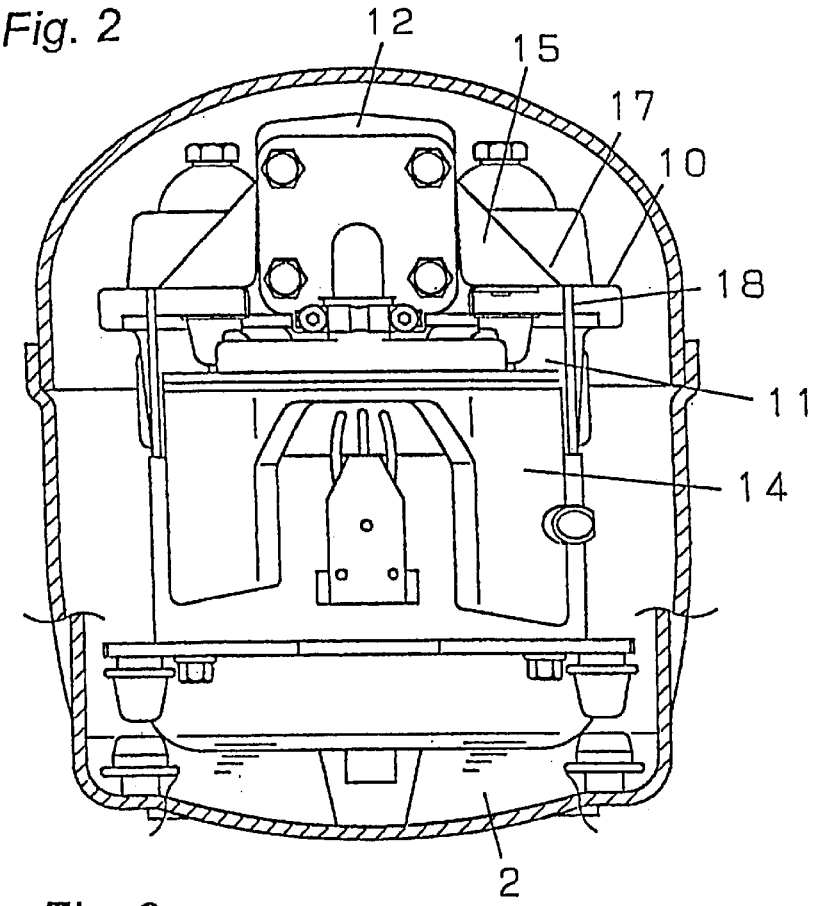
FIG. 2 is a sectional view taken along line II—II in FIG. 1.
Figure 3:
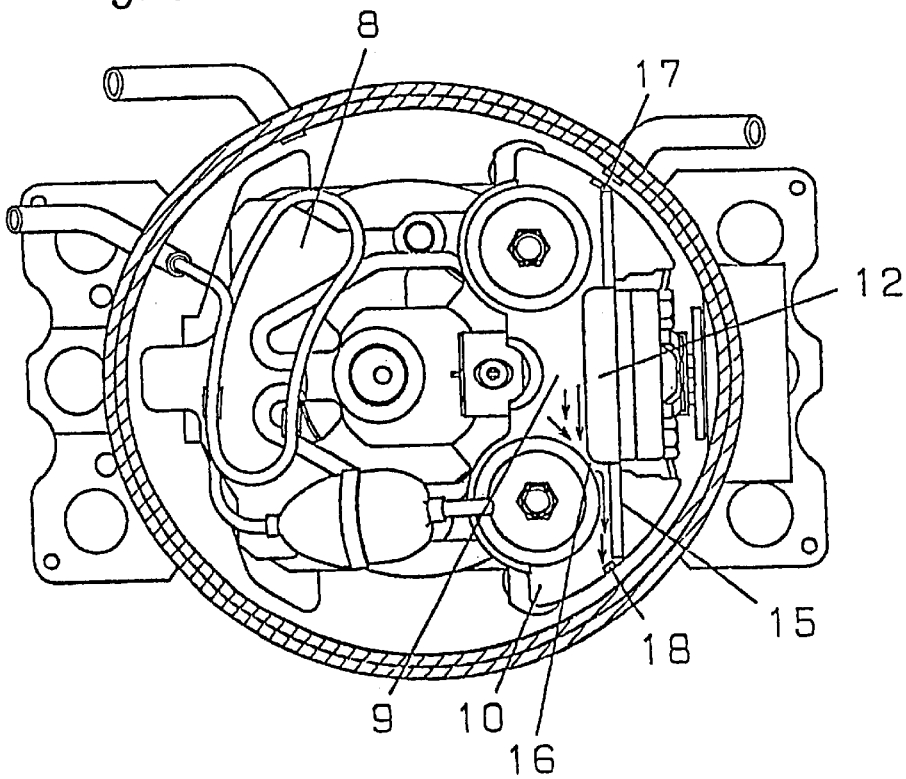
FIG. 3 is a sectional view taken along line III—III in FIG. 1.

Referring now to the drawings, there is shown in FIGS. 1 to 3 a closed motor-driven compressor embodying the present invention. The compressor shown therein includes a closed vessel 1 containing a lubricating oil 2 collected in a bottom portion thereof. The closed vessel 1 accommodates a compression section 3 and a motor section 4 disposed below the compression section 3, both of which are elastically supported therein. The compression section 3 is driven by the motor section 4 via a crankshaft 5, which has a lower end 6 submerged in the lubricating oil 2 and an upper end 7. The crankshaft 5 is rotatably supported by a block 8 having a cylinder 9 integrally formed therewith. The cylinder 9 has generally flat shoulder portions 10 formed on respective sides thereof. The block 8 is rigidly secured to the motor section 4 via two legs 11 and has a rib 12 integrally formed therewith. The legs 11 are used to secure the block 8 to the motor section 4. A cylinder head 13 for covering an open end of the cylinder 9 is secured to the rib 12, and a suction muffler 14 is disposed below the rib 12. A generally triangular oil stopper or oil retainer wall 15 is formed on each side of the rib 12 and connected to both the rib 12 and associated one of the generally flat shoulder portions 10. The oil retainer wall 15 terminates at a position 17 on the associated one of the generally flat shoulder portions 10. A side groove 16 is formed between the oil retainer wall 15 and the cylinder 9. Each leg 11 has an oil guide groove 18 defined therein so as to extend downwardly from associated one of the generally flat shoulder portions 10. The oil guide groove 18 has a generally U-shaped cross section, and an upper end thereof is located adjacent to the position 17.

The closed motor-driven compressor of the above-described construction operates as follows.

When the operation of the compressor is started, the crankshaft 5 is rotated by the motor section 4, and the lubricating oil 2 sucked up from the lower end 6 of the crankshaft 5 spouts out from the upper end 7 of the crankshaft 5 and is then sprinkled on the closed vessel 1, cylinder 9, rib 12 and the like. The resultant drops of oil pass through the side grooves 16 and flow towards the generally flat shoulder portions 10 along the oil retainer walls 15. When the oil collected on the generally flat shoulder portions 10 overflows, it passes through the oil guide grooves 18 in the legs 11 until it reaches the bottom portion of the closed vessel 1. At this moment, the oil retainer walls 15 prevent the oil from dropping on and flowing over the suction muffler 14, and also prevent the oil from dropping directly on the bottom portion of the closed vessel 1. That is, the oil retainer walls 15 and the oil guide grooves 18 serve as oil guides for guiding the oil to the bottom portion of the closed vessel 1.

Although in the above-described embodiment an oil guide groove 18 formed in each leg 11 is used as the oil guide, vertically extending relatively long projections may be formed on each leg 11 to guide the oil to the bottom portion of the closed vessel 1.

Although the present invention has been fully described by way of examples with reference to the accompanying drawings, it is to be noted here that various changes and modifications will be apparent to those skilled in the art.

What is claimed is:

1. A closed motor-driven compressor comprising:

a closed vessel (1) containing a lubricating oil (2) collected in a bottom portion thereof;

a compression section (3) accommodated in the closed vessel (1) and comprising:

a crankshaft (5) having a lower end (6) submerged in the lubricating oil (2) and an upper end (7);

a block (8) for rotatably supporting the crankshaft (5), the block (8) having a cylinder (9) that is formed therewith and has an open end, the block (8) also having a rib (12) formed therewith, a generally flat shoulder portion (10) formed on one side of the cylinder (9), and a leg (11) formed below the generally flat shoulder portion (10); and a cylinder head (13) secured to the rib (12) for covering the open end of the cylinder (9);

a motor section (4) accommodated in the closed vessel (1) for driving the compression section (3) via the crankshaft (5), the leg (11) being secured to the motor section (4);

a suction muffler (14) disposed below the rib (12); and an oil guide (15, 16, 18) formed with the block (8) for guiding to the bottom portion of the closed vessel (1) a lubricating oil (2) that is sucked up from the lower end (6) of the crankshaft (5), caused to spout out from the upper end (7) of the crankshaft (5), and collected on the generally flat shoulder portion (10), characterized in that the oil guide (15, 16, 18) comprises an oil retainer wall (15) formed on one side of the rib (12) and connected to both the rib (12) and the generally flat shoulder portion (10).

2. The closed motor-driven compressor according to claim 1, characterized in that the oil guide (15, 16, 18) comprises an oil groove (18) extending downwardly from the generally flat shoulder portion (10).

* * * * *